United States Patent [19]

Lu

[11] Patent Number: 4,846,027

[45] Date of Patent: Jul. 11, 1989

[54] SCREWDRIVER

[75] Inventor: Jau T. Lu, Taichung Hsien, Taiwan

[73] Assignee: Taiwan Silver Star Industrial Co., Ltd., Ta Taichung Hsien, Taiwan

[21] Appl. No.: 234,560

[22] Filed: Aug. 19, 1988

[51] Int. Cl.[4] ..... B25B 17/00

[52] U.S. Cl. ..... 81/57.3; 81/57.42

[58] Field of Search ..... 81/57.3, 57.33, 57.31, 81/57.42, 57.14

[56] References Cited

U.S. PATENT DOCUMENTS

| | | | |
|---|---|---|---|
| 2,721,591 | 10/1955 | Criswell | 81/57.31 |
| 2,756,792 | 7/1956 | Hirschman | 81/57.3 |
| 2,979,089 | 4/1961 | Piesker | 81/57.31 |
| 4,048,874 | 9/1977 | Riches | 81/57.31 |

*Primary Examiner*—Frederick R. Schmidt
*Assistant Examiner*—Lawrence Cruz
*Attorney, Agent, or Firm*—Keaty & Keaty

[57] ABSTRACT

A screwdriver comprising a handle with a central toothed recess formed thereon and a blind hole concentrically formed thereunder and having two retaining projections projecting therefrom, a speed change gear train disposed between the retaining projections, a spindle with a primary gear, constituting the gear train in part, integrally formed thereon and the lower end thereof received in the blind hole, a housing with an engaging device to engage with the driving gear of the gear train disposed around the gear train, a cover having a central bore formed therethrough screwed on the housing, and a sleeve of which the diameter thereof is less than the bore and of which the lower end engages with the upper end of the spindle and the upper end receives a shank which has a driving bit formed thereon. Thus, the rotation of the housing is transmitted to the driving bit via the speed change gear train with a higher speed.

2 Claims, 5 Drawing Sheets

SCREWDRIVER

BACKGROUND OF THE INVENTION

The present invention relates to a hand tool such as a screwdriver or the like having a speed change gear train incorporated therein to provide the driving bit with higher angular speed than the handle. The present invention further incorporates a direct transmission gear to directly transmit torque to the driving bit without changing the rotational speed.

Conventionally, a screwdriver usually includes a shank integrated with a handle so that the rotation speed is the same for both the shank and the handle. This happens to be inefficient in loosening or tightening a long screw, because almost the whole screwing time is spent in rotating the screw with little torque but at the same low speed as the condition that great torque is required. It is, obviously, efficient to screw with a screwdriver which, instead of providing only the normal operational mode, further provides a high speed operation mode of which the rotational speed of the driving bit is much faster than the handle.

SUMMARY OF THE INVENTION

In view of the foregoing, it is, therefore, the primary object of the present invention to provide a screwdriver of which the rotational speed of the driving bit is higher than that of the handle.

It is the related object of the present invention to provide a screwdriver which, except having a higher rotational speed for the driving bit, further provides a normal operation mode of which the rotation and torque are directly transmitted from the handle to the driving bit and, thus, of which the rotational speeds are the same for both the driving bit and the handle.

Other features and advantages will appear from the following description in conjunction with the accompanying drawings, in which:

DETAILED DESCRIPTION OF THE PREFERRED EMBODIMENT

Figure 1:
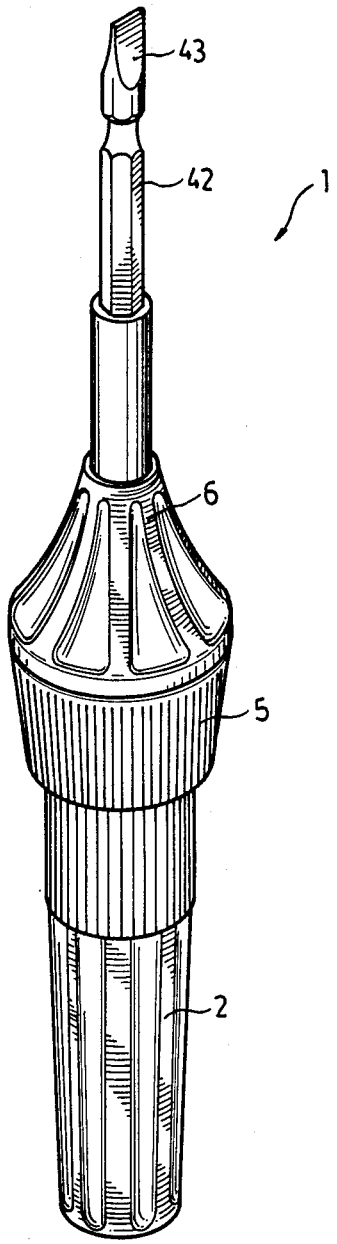
FIG. 1 is a perspective view of a screwdriver in accordance with the present invention.
Figure 2:
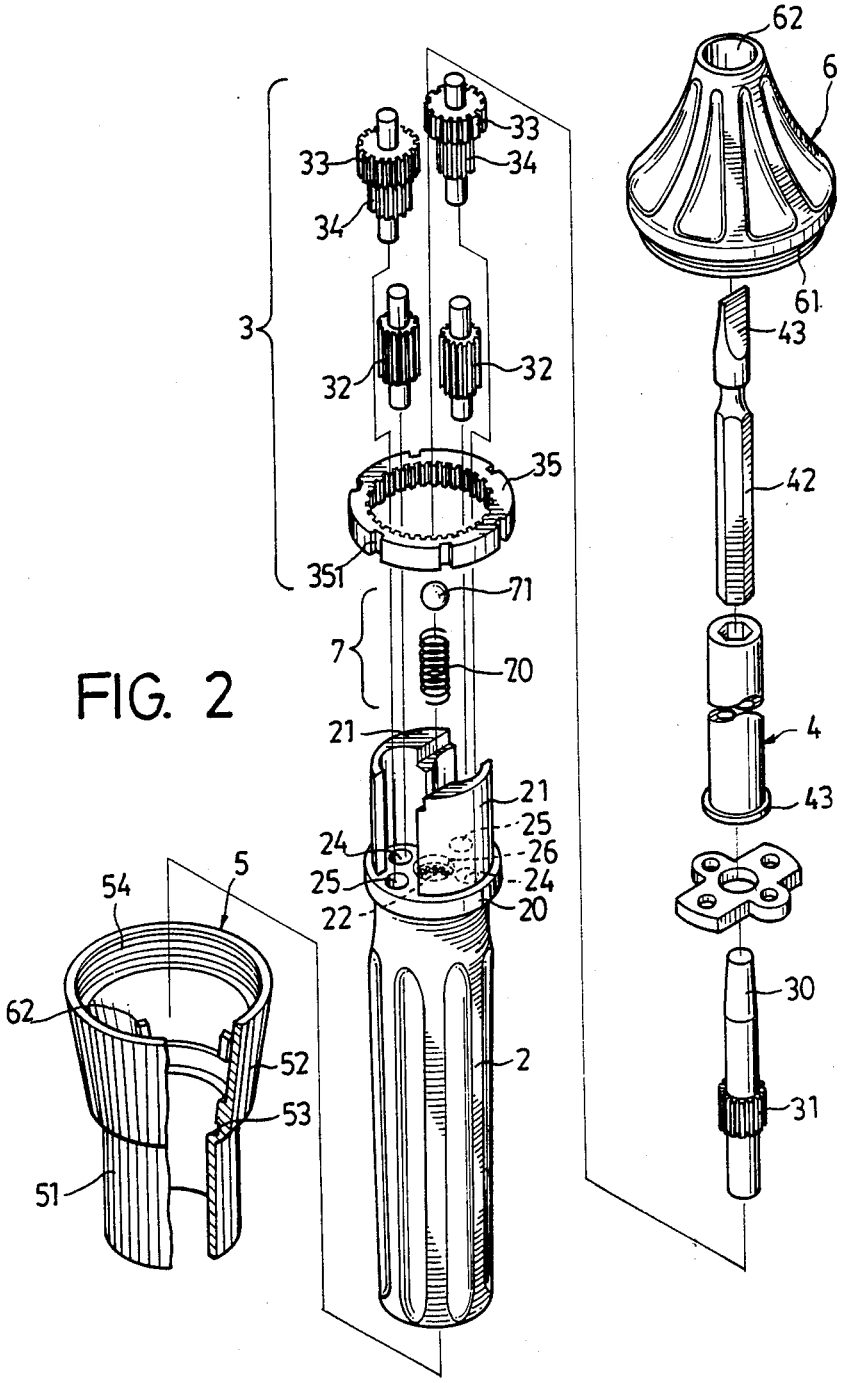
FIG. 2 is a fragmentary view of the screwdriver shown in FIG. 1.
Figure 3:
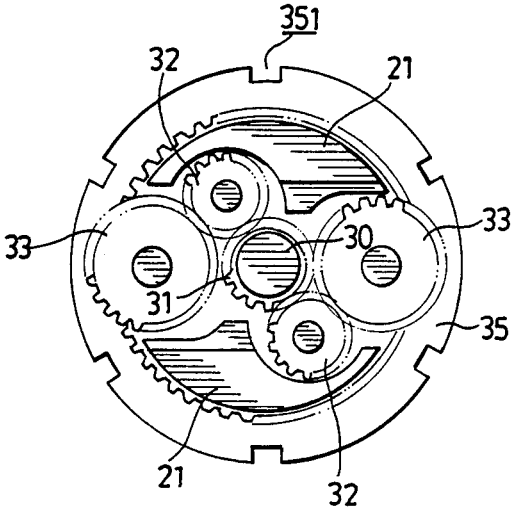
FIG. 3 is a planary view showing the construction of the speed change gear train incorporated in the screwdriver shown in FIG. 1 and 2.

Referring to FIG. 1 and 2, the screwdriver in accordance with the present invention, generally designated by the reference numeral 1, is constituted by a handle 2 with two retaining projections 21 projecting therefrom, a set of speed change gear train which is generally designated by reference numeral 3 and which includes a primary gear 32 formed integrally around a portion of a spindle 30, a pair of secondary gears 32, a pair of tertiary gears 33, a pair of quaternary gears 34, each of which is co-axially integrally disposed with one of the tertiary gears 33, an internal gear 35, supporting plate 41 for supporting the gear train 3, a sleeve 4, a shank 42 with a driving bit 43, a housing 5, a cover 6, and a shank retaining means 7 which includes a coil spring 70 and a ball 71.

The retaining projections 21 are identical in configuration to each other and are anti-symmetrically disposed on the handle 2 to define a space therebetween complemental in size and shape, in part, to the gear train 3 so that the gear train is disposed therebetween. Between the retaining projections 21 a central recess 22 with a central blind hole 23 formed thereunder is formed to receive the lower end of the spindle 30. Between the retaining projections 21, two pair of blind holes 24 and 25 are symmetrically formed on the handle 2 and around the central recess 22 to receive the shafts of the secondary gears 32 and the tertiary gears 33.

The gear train 3 is so constructed that the primary gear 31 which is a portion of the spindle 30 received in the central hole 23 is engageable with the pair of secondary gears 32 which in turn respectively engage with the tertiary gears 33. The quaternary gears 34 which are smaller than the tertiary gears 33 and are respectively co-axially mounted on the same shaft as the tertiary gears 33 engages with the internal gear 35. When the internal gear 35 is rotated, it rotates the quaternary gears 34 and thus the tertiary gears 33 which in turn rotates the secondary gears 32 and finally rotate the primary gear 31 and the spindle 30. The supporting plate 41 which has a central hole with two pairs of holes formed therearound, corresponding to the shafts of the secondary gears 32 and the tertiary gears 33 are disposed on the gear train 3 to provide support for the upper ends of the shafts.

The housing 5 is constituted by a lower cylinder 51 and an upper cylinder 52 with an inner, annular groove 53 disposed therebetween. The lower cylinder 51 with the inside diameter thereof substantially the same with or slightly greater than the diameter of the handle is placed around the upper portion of the handle 2 with the groove 53 engaging with a radial flange 20 formed around the top of the handle 2 so that the upper cylinder 52 which slightly expands outwards substantially surrounds the retaining projections 21 and the gear train 3. At the location corresponding to the internal gear 35, a plurality of tabs 62 are formed around the inner wall of the upper cylinder 52 to engage with a plurality of corresponding notches 351 formed on the outside surface of the internal gear 35 so that when the housing 5 is rotated, the internal gear 35 is rotated too and thus actuating the gear train 3. On the uppermost portion of the upper cylinder 52, an inner thread 54 is formed to engage with the threaded end 61 of the cover 6.

The cover 6, in the form of a truncated cone, has a threaded cone base 61 and a central bore 62 formed therethrough. The bore 62 has an expanded lower portion 63 so as to form a shoulder 64 therebetween. The diameter of the central bore 62 is substantially slightly greater than the outside diameter of the sleeve 42 so that the sleeve 42 with a radial flange 43 formed around the lower end thereof is insertable through the central bore 62 with the flange 42 abutting against the shoulder 64 and is rotatable with respect to the cover 6. The spindle 30 with the lower end thereof received in the central hole 23 formed in the handle 1 and the upper end thereof passing through the central hole formed in the supporting plate 41 engages with the sleeve 4 with the upper end and inserting into the lower portion of the sleeve 4.

The upper end of the sleeve 4 has a polygonal internal cross section to receive the shank 42 with polygonal cross section.

Inside the central hole 23 formed in the handle 2, the ball 71 and the coil spring 70 are disposed, in order, under the spindle 30 to retain the spindle 30 in the position where the primary gear 31 engages the secondary gears 32. When the shank 22, together with the sleeve 21 and the spindle 30, is depressed, the primary gear 31 slides down, disengaging the secondary gears 32 and entering the central recess 22. The central recess 22 is internally toothed with the pitch thereof the same as the primary gear 31 so that when the primary gear 31 slides into the recess 22, it engages the teeth 26 to transmit rotation and torque directly from the handle 2 to the driving bit 43.

OPERATION

Figure 4:
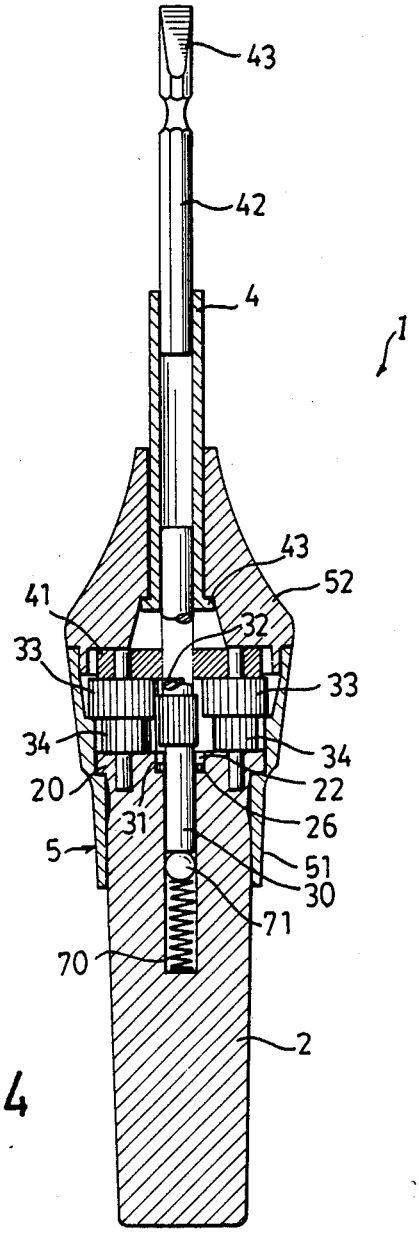
FIG. 4 shows the high speed operation mode of the present invention which provides the driving bit of the screwdriver with a higher rotational speed than the handle.

Referring to FIG. 4 which shows the high speed operation mode, the spindle 30 is pushed to the uppermost position by the coil spring 70 so that the primary gear 31 engages with the secondary gears 32. In this case, due to the suitably selected gear ratio of the gear train 3, the rotation of the shank 42 or the driving bit 43, although being transmitted from the housing 5, rotates than the housing 5.

Figure 5:
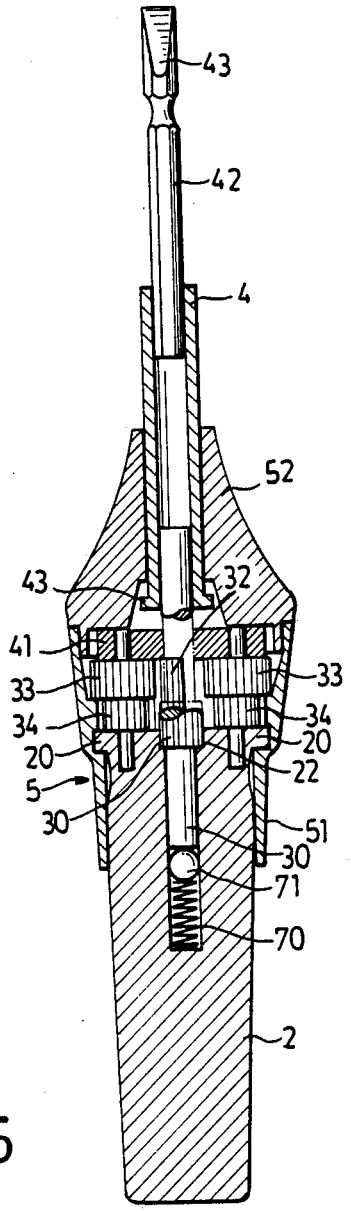
FIG. 5 shows the normal operation mode of the present invention which provides the driving bit with the same rotational speed as the handle.

Referring to FIG. 5 which shows the normal operation mode the spindle 30 is depressed and the primary gear 31 enters the recess 22 and engages the teeth 26. Under this condition, instead of being transmitted from the housing 5, the rotation of the driving bit 43 comes directly from the handle 1.

If, under certain conditions, great torque is required in screwing, the user pushes and presses the screwdriver 1, making the primary gear 31 enter engagement with the teeth 26 formed in the central recess 22 of the handle 2. Thus the driving bit 43 is rotated directly from the user and the user can apply great torque to the screw at a lower rotational speed.

If great torque is not necessary, the user may just hold the handle and, in that case, the primary gear 31, for not being depressed, engages with the secondary gears 32. The user can thus rotate the housing to supply a rotation of higher speed to the driving bit 43.

It is to be understood that the embodiment of the present invention as shown and described is to be regarded as illustration only and that the invention is susceptible to variations, modifications and changes within the scope of the appended claims.

I claim:

1. A screwdriver comprising a handle having two retaining projections projecting therefrom, a speed change gear train disposed between said retaining projections, a central spindle with a primary gear, constituting, in part, said speed change gear train, integrated thereon and the lower end thereof received in a central blind hole formed in the handle, a sleeve of which the lower end engages with the upper end of said spindle, a shank with a driving bit integrally formed in one end and the other end received in the upper end of said sleeve, a housing disposed around said gear train and a cover with a central bore threaded with said housing;

said gear train including a primary gear integrally formed on said spindle, a pair of secondary gears respectively engageable with said primary gear, a pair of tertiary gears engaging with said secondary gears, a pair of quaternary gears smaller in size than said tertiary gears and co-axially, integrally mounted on the same shaft with said tertiary gears respectively, and an internal gear engaging said quaternary gears and having a plurality of notches formed around the outside surface thereof corresponding to and engaging with a plurality of tabs formed inside said housing so that when said housing is rotated, the rotation is transmitted to said primary gear and thus said spindle with higher speed via said quaternary gears, said tertiary gears, and said secondary gears;

the lower ends of the shafts of said tertiary gears and said secondary gears being disposed in two pairs of blind holes formed around said central hole and the upper ends of said shafts being supported by a supporting plate with a central hole formed therethrough and two pairs of holes corresponding to said two pairs of blind holes formed around said central hole to receive said upper ends;

said central bore of said cover having an expanded lower portion to form a shoulder therebetween so that said sleeve with a radial flange formed around the lower end thereof and the diameter thereof substantially smaller than said bore is inserted through said bore with said flange abutting said shoulder and thus rotatable with respect to said cover.

2. A screwdriver as set forth in claim 1 further comprising a ball and a coil spring disposed, in order, inside the blind hole of said handle and under said spindle to retain said spindle in the position where the primary gear is in engagement with said secondary gear and comprising an internally toothed recess concentrically formed around the opening of said central hole with the pitch of said teeth the same as said primary gear so that when said shank, together with said sleeve and said spindle, is depressed, said primary gear loses engagement with said secondary gears, entering said toothed recess to engage therewith and transmitting torque and rotation directly from said handle to said driving bit via said spindle and said sleeve.

* * * * *